US007223157B2

(12) United States Patent
Chen et al.

(10) Patent No.: US 7,223,157 B2
(45) Date of Patent: May 29, 2007

(54) CHEMICAL-MECHANICAL POLISHING APPARATUS AND METHOD OF CONDITIONING POLISHING PAD

(75) Inventors: Sheng-Yu Chen, Taichung County (TW); Te-Sung Hung, Hsinchu (TW); Chung-Jun Cheng, Hsinchu County (TW); Chi-Piao Cheng, Taipei (TW); Po-Yuan Cheng, Hsinchu (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 11/162,120

(22) Filed: Aug. 30, 2005

(65) Prior Publication Data

US 2007/0049183 A1 Mar. 1, 2007

(51) Int. Cl.
*B24B 5/00* (2006.01)

(52) U.S. Cl. ..... 451/41; 451/60; 451/287

(58) Field of Classification Search ..... 451/36, 451/37, 38, 60, 283, 284, 285, 286, 287, 451/443, 444, 446, 56
See application file for complete search history.

(56) References Cited

U.S. PATENT DOCUMENTS

| | | | | |
|---|---|---|---|---|
| 6,126,517 | A * | 10/2000 | Tolles et al. | 451/41 |
| 2004/0192174 | A1* | 9/2004 | Sharples et al. | 451/41 |
| 2005/0186891 | A1* | 8/2005 | Benner | 451/56 |

* cited by examiner

*Primary Examiner*—Jacob K. Ackun, Jr.
(74) *Attorney, Agent, or Firm*—Jianq Chyun IP Office

(57) ABSTRACT

A chemical-mechanical polishing apparatus comprising at least a polishing platen, a polishing pad, a slurry supplying piping, a polishing pad conditioner, a chemical reagent supplying piping and a splitting piping is provided. The polishing platen has a plurality of slurry outlets disposed thereon and the polishing pad is disposed on the polishing platen. The slurry supplying piping is connected to the bottom of the polishing platen for delivering slurry to the surface of the polishing pad through the slurry outlets. The polishing pad conditioner is disposed over the polishing pad. The chemical reagent supplying piping is connected to the polishing pad conditioner for supplying the chemical reagent to the polishing conditioner. The splitting piping is connected between the slurry supplying piping and the chemical reagent supplying piping for providing chemical reagent to the surface of the polishing pad through the slurry supplying piping and the slurry outlets.

14 Claims, 2 Drawing Sheets

CHEMICAL-MECHANICAL POLISHING APPARATUS AND METHOD OF CONDITIONING POLISHING PAD

BACKGROUND OF THE INVENTION

1. Field of the Invention

The present invention relates to a chemical-mechanical polishing (CMP) apparatus. More particularly, the present invention relates to a chemical-mechanical polishing (CMP) apparatus and a method of conditioning a polishing pad capable of improving the polishing effect.

2. Description of the Related Art

With the trend of minimized device dimensions, the resolution of photo-exposure needs to be correspondingly increased. Furthermore, as the depth of a photolithography-exposure reduces, the tolerance for any undulation in the surface profile of the chip is lower. Chemical-mechanical polishing is currently one of the techniques capable of providing global planarization to an ultra-large scale integrated (ULSI) circuit. Aside from planarizing the surface profile of a chip, the anisotropic polishing characteristic of the chemical-mechanical polishing process is applied to fabricate vertical and horizontal metallic interconnects through metal polishing operations, to fabricate shallow trench isolation structures in an front stage manufacturing process or advanced device, to planarize micro-electromechanical system or to fabricate flat panel display.

FIG. 1 is a schematic drawing of a conventional chemical-mechanical polishing apparatus. As shown in FIG. 1, the conventional chemical-mechanical polishing apparatus 100 comprises at least a polishing platen 110, a polishing pad 120, a slurry supplying piping 130, a polishing pad conditioner 150 and a chemical reagent supplying piping 160.

In FIG. 1, the surface of the polishing platen 110 further comprises a plurality of slurry outlets 112. The polishing pad 120 is disposed on the polishing platen 110. The polishing platen 110 drives the polishing pad 120 to spin through a carrier platform (not shown). With the delivery of slurry, a chemical-mechanical polishing process is carried out to planarize a chip or any structure requiring global planarization in a semiconductor fabrication process.

The slurry supplying piping 130 is connected to the bottom of the polishing platen 110. The slurry is delivered from a slurry supplying tank 140 through the slurry supplying piping 130 underneath the polishing platen 110 and the slurry outlet 112 to the surface of the polishing pad 120. Because the polishing agent is slurry, the slurry outlet 112 may be blocked if the concentration of the slurry is too high or some dregs are clogged up in the slurry outlet 112. As a result, a blocked slurry outlet 112 can not deliver slurry to the polishing pad 120 evenly. The non-uniform slurry distribution on the polishing pad may have some effects on the planarity in subsequent chemical-mechanical polishing process. In some cases, defects will be formed in the fabricated devices.

As shown in FIG. 1, the polishing pad conditioner 150 is disposed on the polishing pad 120. The chemical reagent supplying piping 160 is connected between the polishing pad conditioner 150 and a chemical reagent supplying tank 170. The chemical reagent in the chemical reagent supplying tank 170 is delivered to the polishing pad conditioner 150 through the chemical reagent supplying piping 160.

At the end of a polishing operation, slurry dregs sometimes are attached to the surface of the polishing pad 120. When this happens, the polishing pad conditioner 150 can adjust the condition on the polishing pad 120 by removing dregs from the surface of the polishing pad 120. However, the delivering of chemical reagent to the polishing pad conditioner 150 only has a limited conditioning effect on the polishing pad 120.

SUMMARY OF THE INVENTION

Accordingly, one objective of the present invention is to provide a chemical-mechanical polishing apparatus suitable for improving chemical-mechanical polishing operation as well as polishing pad conditioning operation.

Another objective of the present invention is to provide a method of conditioning a polishing pad such that the conditioned polishing pad can improve the polishing effect in a chemical-mechanical polishing operation.

To achieve these and other advantages and in accordance with the purpose of the invention, as embodied and broadly described herein, the invention provides a chemical-mechanical polishing apparatus. The chemical-mechanical polishing apparatus comprises at least a polishing platen, a polishing pad, a slurry supplying piping, a polishing pad conditioner, a chemical reagent supplying piping and a splitting piping. The surface of the polishing platen comprises a plurality of slurry outlets. The polishing pad is disposed on the polishing platen. The slurry supplying piping is connected to the bottom of the polishing platen, suitable for delivering slurry from under the polishing platen to a polishing pad surface through the slurry outlets. The polishing pad conditioner is disposed over the polishing pad. The chemical reagent supplying piping is connected to the polishing pad conditioner for supplying chemical reagent to the polishing conditioner. The splitting piping is connected between the slurry supplying piping and the chemical reagent supplying piping and is suitable for delivering chemical reagent through the chemical reagent supplying piping, the slurry supplying piping and the slurry outlets to the polishing pad surface.

According to the aforementioned chemical-mechanical polishing apparatus of the present invention, the splitting piping further comprises a first control valve and the slurry supplying piping further comprises a second control valve. To supply slurry to the polishing pad, the first control valve is shut while the second control valve is opened. On the other hand, to supply chemical reagent to the polishing pad, the first control valve is opened while the second control valve is shut.

The present invention also provides a polishing pad conditioning method suitable for the aforementioned chemical-mechanical polishing apparatus. The polishing pad conditioning method comprises providing chemical reagent to a polishing pad conditioner through the chemical reagent supplying piping after polishing the to-be-polished layer on a wafer using the chemical-mechanical polishing apparatus. In the meantime, the chemical reagent is also delivered to the polishing pad through the splitting piping and the slurry supplying piping. The polishing pad conditioner is used to condition the surface of the polishing pad.

According to the aforementioned polishing pad conditioning method of the present invention, the to-be-polished layer on the wafer includes a metallic layer.

According to the aforementioned polishing pad conditioning method of the present invention, the metallic layer comprises copper and the slurry comprises an acid solution and the chemical reagent comprises an acid solution such as a folic acid containing solution.

According to the aforementioned polishing pad conditioning method of the present invention, the metallic layer comprises tungsten and the slurry comprises an acid solution and the chemical reagent comprises a deionized water.

According to the aforementioned polishing pad conditioning method of the present invention, the metallic layer comprises tantalum nitride and the slurry comprises an alkaline solution and the chemical reagent comprises a deionized water.

In the present invention, a chemical reagent supplying piping capable of delivering chemical reagent above and below the polishing pad is provided. Thus, chemical reagent can be delivered to the polishing pad via the bottom of the polishing platen to dissolve any slurry dregs blocking the slurry outlets. Hence, the slurry can be more uniformly distributed on the polishing pad surface in a subsequent polishing process to improve the polishing effect. In addition, the chemical reagent for conditioning the polishing pad is delivered to the polishing pad from above and below so that the chemical reagent can be uniformly distributed on the surface of the polishing pad, which can better condition the polishing pad and provide better polishing effect in a subsequent chemical-mechanical polishing process.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
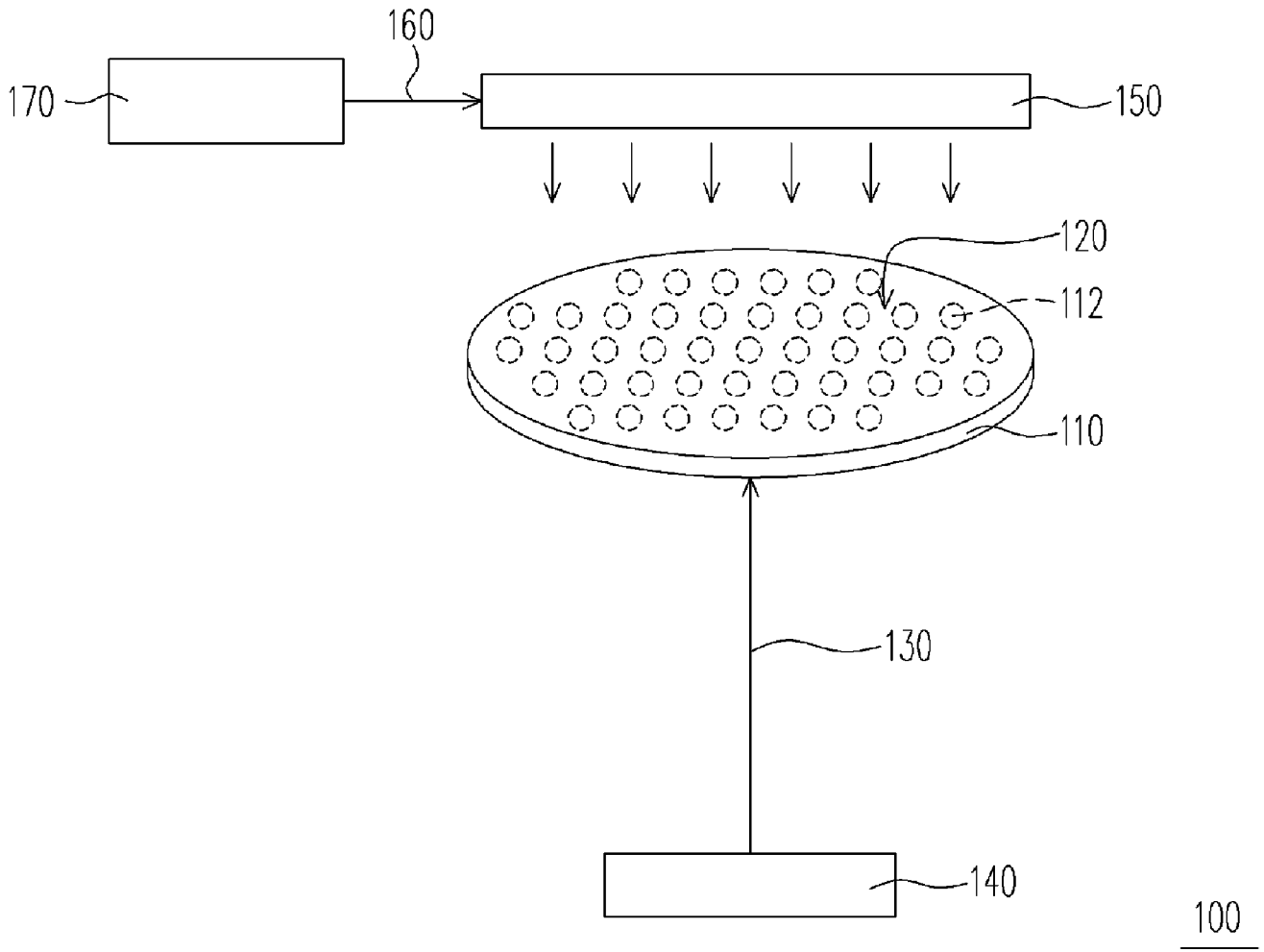
FIG. 1 (PRIOR ART)
FIG. 1 is a schematic drawing of a conventional chemical-mechanical polishing apparatus.

Reference will now be made in detail to the present embodiments of the invention, examples of which are illustrated in the accompanying drawings. Wherever possible, the same reference numbers are used in the drawings and the description to refer to the same or like parts.

Figure 2:
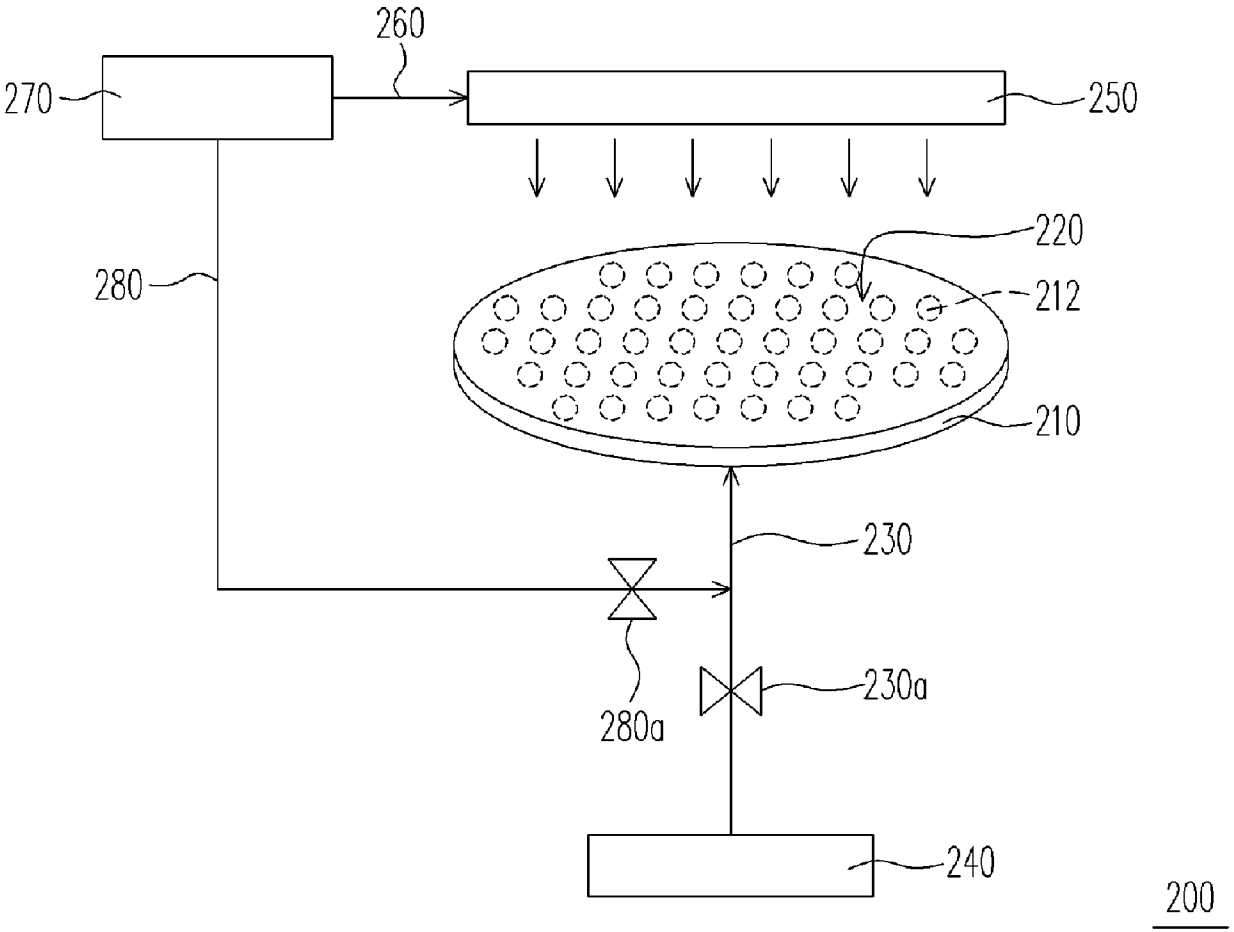
FIG. 2 is a schematic drawing of a chemical-mechanical polishing apparatus according to one embodiment of the present invention.

FIG. 2 is a schematic drawing of a chemical-mechanical polishing apparatus according to one embodiment of the present invention. As shown in FIG. 2, the chemical-mechanical polishing apparatus 200 of the present embodiment comprises at least a polishing platen 210, a polishing pad 220, a slurry supplying piping 230, a polishing pad conditioner 250, a chemical reagent supplying piping 260 and a splitting piping 280.

As shown in FIG. 2, the polishing platen 210 is disposed on a carrier platform (not shown). The polishing platen 210 is spun driven by the carrier platform. The polishing pad 220 is disposed on the polishing platen 210, and spins with the polishing platen 210 to polish the to-be-polished layer.

As shown in FIG. 2, the surface of the polishing platen 210 comprises a plurality of slurry outlets 212. The slurry supplying piping 230 is connected to the bottom of the polishing platen 210, suitable for supplying slurry from under the polishing platen 210 to the surface of the polishing pad 220 via the slurry outlets 212. The surface of the polishing pad 210 also comprises a plurality of tiny holes (not shown). The holes facilitate the transportation of slurry to the polishing surface of the polishing pad 210 such that the polishing pad 210 may perform the polishing operation on a to-be-polished layer.

As shown in FIG. 2, the polishing pad conditioner 250 is disposed above the polishing pad 220. The chemical reagent supplying piping 260 is connected to the polishing pad conditioner 250. The chemical reagent supplying piping 260 is suitable for delivering a chemical reagent to the polishing pad conditioner 250. The polishing pad conditioner 250 comprises a plurality of diamond brush conditioning heads contacting the polishing pad 220 for removing any rough and uneven felt on the surface of the polishing pad 220 as well as any slurry dregs adhering to the surface of the polishing pad 220. Furthermore, the chemical reagent also reacts with the slurry dregs adhered to the polishing pad 220 and increases the efficiency of removing slurry dregs.

As shown in FIG. 2, the splitting piping 280 is connected between the slurry supplying piping 230 and the chemical reagent supplying piping 260. The splitting piping 280 is suitable for delivering the chemical reagent to the surface of the polishing pad 220 via the chemical reagent supplying piping 260, the slurry supplying piping 230 and the slurry outlets 212.

In one embodiment, the splitting piping 280 is designed to allow the delivery of chemical reagent to the polishing pad 220 from under the polishing pad 220 for an conditioning operation on the polishing pad 220. In particular, since the chemical reagent can be supplied from the bottom of the polishing pad 220, the chemical reagent can dissolve the slurry dregs accumulated near the slurry outlets 212 when passing through the slurry outlets 220 in the polishing platen 210. Thus, the chemical reagent also serves as a cleaning agent for the slurry outlets 212.

In one embodiment of the present invention, the splitting piping 280 may further comprise a control valve 280*a* and the slurry supplying piping 230 may further comprise another control valve 230*a*. When supplying slurry to the polishing pad 220, the control valve 280*a* is shut while the control valve 230*a* is opened. On the other hand, when supplying chemical reagent to the polishing pad 220, the control valve 280*a* is opened while the control valve 230*a* is shut.

The control valve 280*a* on the splitting piping 280 is used to control the flow of the chemical reagent. The control valve 230*a* on the slurry supplying piping 230 is used to control the flow of the slurry. In one embodiment, when the control valve 280*a* is opened, the control valve 230*a* is shut. In this configuration, the chemical reagent can flow from the chemical reagent supplying piping 260 to the polishing pad conditioner 250 and then drop onto the surface of the polishing pad 220 from above. Also the chemical reagent can be delivered to the surface of the polishing pad 220 from below via the splitting piping 280, the control valve 280*a*, the slurry supplying piping 230 and the slurry outlets 212 for conditioning the polishing pad 220.

Conversely, when the control valve 280*a* is shut and the control valve 230*a* is opened, slurry can flow from a slurry supplying tank 240 to the polishing pad 220 through the slurry supplying piping 230 and the slurry outlets 212 for carrying out a chemical-mechanical polishing operation.

Since the chemical-mechanical polishing apparatus 200 in the present embodiment uses a splitting piping 280, chemical reagent can be delivered to the polishing pad 220 two way from above and below. In the process of providing chemical reagent from below the polishing pad 220, the chemical reagent also dissolves any slurry particles blocking the slurry outlets 212. Hence, the slurry can be evenly distributed over the polishing pad 220 to improve polishing performance is subsequent polishing operation.

FIG. 2 can also be used to illustrate the method of conditioning a polishing pad 220 according to the present invention. The polishing pad conditioning method is suitable for the aforementioned chemical-mechanical polishing apparatus 200.

After the to-be-polished layer (not shown) on a wafer (not shown) has been polished using the chemical-mechanical polishing apparatus 200, chemical reagent is supplied to the polishing pad conditioner 250 through the chemical reagent supplying piping 260. In the meantime, chemical reagent is also supplied to the polishing pad 220 via the splitting piping 280 and the slurry supplying piping 230 and the polishing pad conditioner 250 is activated to condition the surface of the polishing pad 220. As shown in FIG. 2, the polishing pad 220 conditioning method of the present embodiment comprises the following steps.

First, chemical reagent is transported from a chemical reagent supplying tank 270 to the polishing pad conditioner 250 via the chemical reagent supplying piping 260 and then the chemical reagent is delivered to the polishing pad 220 from above. At the same time, the control valve 280*a* is opened while the control valve 230*a* is shut so that the chemical reagent can flow to the polishing pad 220 from under via the splitting piping 280, the slurry supplying piping 230 and the slurry outlets 212. Because the control valve 230*a* is in a shutdown state, no slurry will go to the polishing pad 220 via the slurry supplying piping 230.

Thereafter, the polishing pad conditioner 250 is used to condition the surface of the polishing pad 220. The polishing pad conditioner 250 comprises, for example, a plurality of diamond brush conditioning heads contacting the polishing pad 220. With the chemical reagent delivered to the polishing pad 220 from above and below, slurry dregs and felts adhered to the surface of the polishing pad 220 can be removed. Thus, a certain degree of roughness can be maintained in the polishing pad 220 so that the polishing pad 220 can absorb sufficient slurry to provide a highly stable polishing rate in a subsequent chemical-mechanical polishing operation.

As shown in FIG. 2, in the aforementioned conditioning steps, the chemical reagent can be delivered to the polishing pad 220 from below and then react with slurry dregs blocking the slurry outlets 212 to facilitate its removal. In other words, the slurry outlets 212 can be kept clean so that the slurry can be evenly distributed on the polishing pad 220 to improve the chemical-mechanical polishing performance of the chemical-mechanical polishing apparatus 200 and extend the working life of the polishing platen 210.

In addition, the aforementioned to-be-polished layer on the wafer is a metallic layer, for example. The material of metallic layer is copper and the corresponding slurry comprises an acid solution and the chemical reagent comprises an acid solution such as a folic acid containing solution. In another embodiment, the material of aforementioned metallic layer is tungsten and the corresponding slurry comprises an acid solution and the chemical reagent comprises a deionized water, for example. In yet another embodiment, the material of metallic layer is tantalum nitride and the corresponding slurry comprises an alkaline solution and the chemical reagent comprises a deionized water, for example.

In summary, the chemical-mechanical polishing apparatus and polishing pad conditioning method of the present invention have at least the following advantages.

1. The splitting piping of the chemical-mechanical polishing apparatus allows the chemical reagent to remove slurry dregs blocking the slurry outlets when passing through during a polishing pad conditioning operation. Hence, the polishing performance of subsequent polishing operation can be improved.

2. Chemical reagent is delivered to the polishing pad from above and below so that a better conditioning performance of the polishing pad is achieved.

3. Because the slurry outlets of the chemical-mechanical polishing apparatus are less likely to be blocked, the polishing platen can have a longer life span.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A chemical mechanical polishing apparatus, at least comprising:

a polishing platen, wherein the polishing platen has a surface with a plurality of slurry outlets thereon;

a polishing pad disposed on the polishing platen;

a slurry supplying piping connected to a bottom of the polishing platen for delivering slurry from underneath of the polishing platen to a polishing pad surface through the slurry outlets;

a polishing pad conditioner disposed over the polishing pad;

a chemical reagent supplying piping connected to the polishing pad conditioner for supplying a chemical reagent to the polishing pad conditioner; and a splitting piping connected between the slurry supplying piping and the chemical reagent supplying piping for delivering the chemical reagent to the polishing pad surface through the chemical reagent supplying piping, the slurry supplying piping and the slurry outlets.

2. The chemical-mechanical polishing apparatus of claim 1, wherein a first control valve is disposed on the splitting piping and a second control valve is disposed on the slurry supplying piping.

3. A polishing pad conditioning method, applied to a chemical mechanical polishing apparatus of claim 1 after a to-be-polished layer on a wafer is polished using the chemical-mechanical polishing apparatus, the conditioning method comprising:

supplying chemical reagent to a polishing pad conditioner through the chemical reagent supplying piping and simultaneously supplying the chemical reagent to the polishing pad through the splitting piping and the slurry supplying piping, and using the polishing pad conditioner to condition the polishing pad surface.

4. The conditioning method of claim 3, wherein the to-be-polished layer on the wafer comprises a metallic layer.

5. The conditioning method of claim 4, wherein the metallic layer comprises copper.

6. The conditioning method of claim 5, wherein the slurry comprises an acid solution.

7. The conditioning method of claim 5, wherein the chemical reagent comprises an acid solution.

8. The conditioning method of claim 7, wherein the chemical reagent comprises a solution containing folic acid.

9. The conditioning method of claim 4, wherein the metallic layer comprises tungsten,.

10. The conditioning method of claim 9, wherein the slurry comprises an acid solution.

11. The conditioning method of claim 9, wherein the chemical reagent comprises a deionized water.

12. The conditioning method of claim 4, wherein the metallic layer comprises tantalum nitride.

13. The conditioning method of claim 12, wherein the slurry comprises an alkaline solution.

14. The conditioning method of claim 12, wherein the chemical reagent comprises a deionized water.

* * * * *